US009683496B2

(12) United States Patent
Kojima

(10) Patent No.: US 9,683,496 B2
(45) Date of Patent: Jun. 20, 2017

(54) CONTROL APPARATUS AND CONTROL METHOD FOR INTERNAL COMBUSTION ENGINE

(71) Applicant: Toyota Jidosha Kabushiki Kaisha, Toyota-shi, Aichi-ken (JP)

(72) Inventor: Susumu Kojima, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 177 days.

(21) Appl. No.: 14/468,971

(22) Filed: Aug. 26, 2014

(65) Prior Publication Data

US 2015/0059688 A1 Mar. 5, 2015

(30) Foreign Application Priority Data

Aug. 27, 2013 (JP) ..... 2013-175224

(51) Int. Cl.

| | |
|---|---|
| ***F02D 37/02*** | (2006.01) |
| ***F02D 41/04*** | (2006.01) |
| ***F02N 19/00*** | (2010.01) |
| ***F02N 99/00*** | (2010.01) |
| *F02D 13/02* | (2006.01) |

(52) U.S. Cl.

CPC ..... *F02D 37/02* (2013.01); *F02D 41/042* (2013.01); *F02N 19/005* (2013.01); *F02N 99/006* (2013.01); *F02D 13/0249* (2013.01); *F02N 2300/2006* (2013.01)

(58) Field of Classification Search

CPC .... F02D 37/02; F02D 41/042; F02D 13/0249; F02N 99/006; F02N 19/005; F02N 2300/2006

USPC ..... 701/22, 102, 103, 105, 112; 180/65.265, 180/65.28, 335; 123/179.3, 179.4, 406.47

See application file for complete search history.

(56) References Cited

U.S. PATENT DOCUMENTS

| | | | | |
|---|---|---|---|---|
| 6,550,457 | B1 * | 4/2003 | Kitagawa | F02D 41/105 123/486 |
| 2005/0066933 | A1 | 3/2005 | Kaita et al. | |
| 2005/0109302 | A1 * | 5/2005 | Tetsuno | F02D 41/042 123/179.5 |
| 2006/0266020 | A1 * | 11/2006 | Okamoto | F02D 37/02 60/284 |
| 2008/0092841 | A1 * | 4/2008 | Takahashi | F02D 41/009 123/179.16 |

(Continued)

FOREIGN PATENT DOCUMENTS

| | | |
|---|---|---|
| JP | 2004-360549 A | 12/2004 |
| JP | 2005-105885 A | 4/2005 |

(Continued)

*Primary Examiner* — Joseph Dallo

(74) *Attorney, Agent, or Firm* — Dinsmore & Shohl LLP

(57) ABSTRACT

A control apparatus for an internal combustion engine that can be a four-cycle engine including cylinders into which fuel is directly injected, the control apparatus includes an electronic control unit. The electronic control unit is configured to execute a fuel injection and an ignition for the cylinder in an expansion stroke on a condition that a stop of the piston in any one of the cylinders at vicinity of a top dead center after a compression stroke is predicted when the electronic control unit is configured to stop the fuel injection and the ignition for the internal combustion engine upon fulfillment of a predetermined stop condition.

19 Claims, 9 Drawing Sheets

(56) References Cited

U.S. PATENT DOCUMENTS

| | | | | |
|---|---|---|---|---|
| 2009/0037085 | A1 | 2/2009 | Kojima | |
| 2009/0125212 | A1* | 5/2009 | Kurashima | F02D 41/062 701/103 |
| 2009/0164101 | A1* | 6/2009 | Kageyama | F02D 37/02 701/103 |
| 2011/0132307 | A1* | 6/2011 | Patterson | F02N 11/0814 123/179.3 |
| 2011/0208411 | A1* | 8/2011 | Tsuji | F02D 41/0005 701/112 |
| 2011/0246046 | A1* | 10/2011 | Ichinose | F02D 17/04 701/103 |
| 2014/0202407 | A1* | 7/2014 | Miyamoto | F02L 1/3442 123/90.15 |
| 2014/0249710 | A1* | 9/2014 | Nakanishi | B60K 6/48 701/22 |
| 2014/0303823 | A1* | 10/2014 | Nakanishi | B60K 6/48 701/22 |

FOREIGN PATENT DOCUMENTS

| | | | | |
|---|---|---|---|---|
| JP | 2006-299997 | A | 11/2006 | |
| JP | WO 2006134439 | A1 * | 12/2006 | F02N 11/0814 |
| JP | 2007-187051 | A | 7/2007 | |
| JP | 2012-082698 | A | 4/2012 | |

* cited by examiner

CONTROL APPARATUS AND CONTROL METHOD FOR INTERNAL COMBUSTION ENGINE

INCORPORATION BY REFERENCE

The disclosure of Japanese Patent Application No. 2013-175224 filed on Aug. 27, 2013 including the specification, drawings and abstract is incorporated herein by reference in its entirety.

BACKGROUND OF THE INVENTION

1. Field of the Invention

The invention relates to a control apparatus and a control method for an internal combustion engine.

2. Description of Related Art

There is known a vehicle that is equipped with an internal combustion engine as a driving force source for running. For example, Japanese Patent Application Publication No. 2005-105885 (JP-2005-105885 A) discloses a hybrid vehicle that includes an internal combustion engine. This internal combustion engine is automatically stopped under a certain condition such as motor running or the like, and the stop position of a crankshaft is controlled by a motor-generator in consideration of the startability at the time when the internal combustion engine is restarted. In Japanese Patent Application Publication No. 2004-360549 (JP-2004-360549 A), as for an in-cylinder injection-type internal combustion engine having cylinders into which fuel is directly injected, there is described an art of controlling the stop position of a crankshaft through the generation of a braking force by burning the mixture in a cylinder during a compression stroke in stopping the internal combustion engine. In this in-cylinder injection-type internal combustion engine, ignition-based startup for rotating a crankshaft through the generation of a normal running torque by explosion is made possible by injecting fuel into the cylinder in an expansion stroke of the internal combustion engine that has stopped rotating, and igniting the fuel.

In a six-cylinder four-cycle internal combustion engine having cylinders into which fuel is directly injected, the crank angles of the respective cylinders are offset from one another by 120 crank angle (CA). Therefore, when the engine stops, a crankshaft is generally stopped at a crank angle at which a piston in any one of the cylinders is located at an intermediate position of an expansion stroke, which is advanced by, for example, 45 to 75 CA from a compression top dead center (TDC) as a top dead center after a compression stroke, due to a relationship between potential energy resulting from the pumping action (the action of something like a spring based on the compression of air) and a rotation inertia force. Thus, the ignition-based startup can be appropriately carried out. However, a stop at the TDC, namely, a stop of the piston in any one of the cylinders in the vicinity of the compression TDC may occur with a probability of about 5 to 10%. In this case, the crank angle of the cylinder in the expansion stroke (the cylinder located immediately in front of the cylinder with a stop at the TDC) is about 120 ATDC (a position advanced from the TDC by 120 CA), and an exhaust valve has already been open or will open soon. Therefore, a sufficient running torque is not obtained through ignition-based startup, so the execution of ignition-based startup may be substantially impossible. The aforementioned stop at the TDC is considered to occur due to friction of the engine or the like when the rotation inertia force and the pumping action are substantially balanced with each other. On the other hand, with a view to avoiding this stop at the TDC, it is conceivable to control the stop position of a crankshaft with the aid of an external force of a motor-generator or the like as is the case with, for example, the above-mentioned Japanese Patent Application Publication No. 2005-105885 (JP-2005-105885 A). It is also conceivable to cause a stop of rotation by burning the mixture in the cylinder in the compression stroke, as is the case with Japanese Patent Application Publication No. 2004-360549 (JP-2004-360549 A).

SUMMARY OF THE INVENTION

However, in the above-mentioned Japanese Patent Application Publication No. 2005-105885 (JP-2005-105885 A) case, it may be necessary to enlarge the motor-generator for applying the external force or the like. In the Japanese Patent Application Publication No. 2004-360549 (JP-2004-360549 A) case, the piston in the cylinder with a stop at the TDC needs to be stopped in the course of the compression stroke. Accordingly, it may be difficult to reliably prevent a stop at the TDC because of a difficulty in the prediction of a stop at the TDC or the timing of combustion etc. This phenomenon may also arise in a seven-cylinder internal combustion engine or an eight-cylinder internal combustion engine.

The invention provides an art of avoiding a stop of a crankshaft at a TDC without recourse to an external force of a motor-generator or the like, such that an internal combustion engine can be more appropriately restarted through ignition-based startup.

A first aspect of the invention provides a control apparatus for an internal combustion engine that can be a four-cycle engine including cylinders into which fuel is directly injected, the control apparatus includes an electronic control unit. The electronic control unit is configured to execute a fuel injection and an ignition for the cylinder in an expansion stroke on a condition that a stop of the piston in any one of the cylinders at vicinity of a top dead center after a compression stroke is predicted when the electronic control unit is configured to stop the fuel injection and the ignition for the internal combustion engine upon fulfillment of a predetermined stop condition. According to the above-mentioned configuration, a normal running torque through explosion is generated. The vicinity of the aforementioned top dead center (TDC) after a compression stroke (compression TDC) means a predetermined range including the TDC, preferably a range of a total of about 20 CA, namely, the TDC±10 CA.

In the control apparatus, the electronic control unit may be configured to execute the fuel injection and the ignition for the cylinder in the expansion stroke, after a recovery condition is satisfied when the fuel injection and the ignition are executed for the cylinder after the stop at the top dead center has occurred. The recovery condition may be a predetermined condition related to an in-cylinder pressure of each of the cylinder.

The internal combustion engine may further includes a variable valve timing device that changes an opening timing of an exhaust valve of the internal combustion engine. In the control apparatus, the electronic control unit may be configured to retard the opening timing of the exhaust valve by the variable valve timing device before the crankshaft stops rotating, when the stop of the piston at vicinity of the top dead center after the compression stroke has been predicted.

A second aspect of the invention provides a control apparatus for an internal combustion engine that can be a four-cycle engine including cylinders into which fuel is directly injected. The control apparatus includes an electronic control unit that is configured to execute a fuel injection and an ignition for the cylinder in an expansion stroke on a condition that a stop of the piston in any one of the cylinders at vicinity of a top dead center after a compression stroke is occurred when the electronic control unit is configured to stop the fuel injection and the ignition for the internal combustion engine upon fulfillment of a predetermined stop condition A third aspect of the invention provides a control method for an internal combustion engine that can be a four-cycle engine including cylinders into which fuel is directly injected and an electronic control unit. The control method includes executing a fuel injection and an ignition, by the electronic control unit, for the cylinder in an expansion stroke on a condition that a stop of the piston in any one of the cylinders at vicinity of a top dead center after a compression stroke is predicted when the electronic control unit is configured to stop the fuel injection and the ignition for the internal combustion engine upon fulfillment of a predetermined stop condition.

BRIEF DESCRIPTION OF THE DRAWINGS

Features, advantages, and technical and industrial significance of an exemplary embodiment of the invention will be described below with reference to the accompanying drawings, in which like numerals denote like elements, and wherein.

DETAILED DESCRIPTION OF EMBODIMENT

Figure 1:
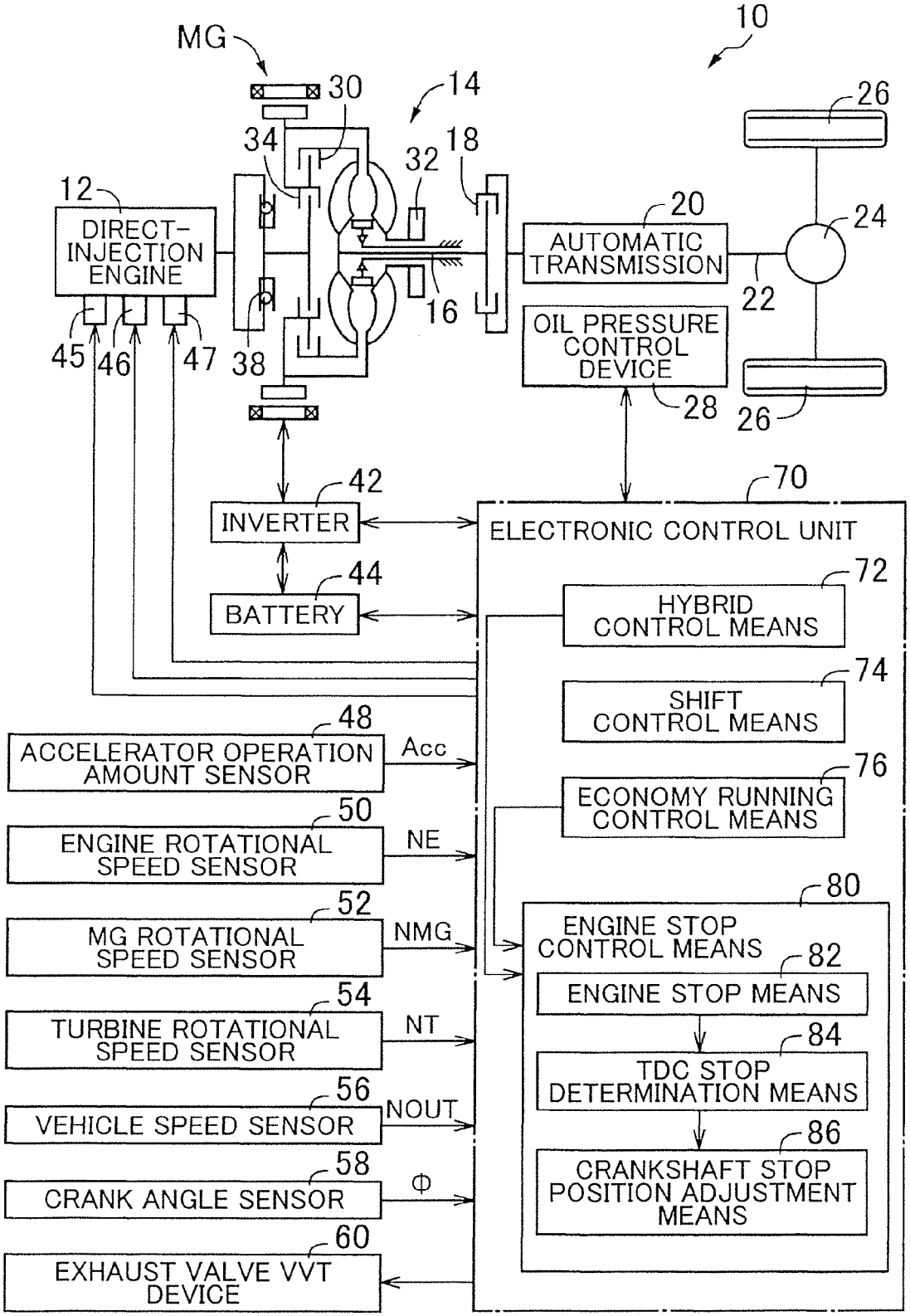
FIG. 1 is a schematic block diagram showing an essential part of a control system in conjunction with a skeleton diagram of a hybrid vehicle according to the embodiment of the invention.

One embodiment of the invention is preferably applied to a six-cylinder internal combustion engine, but is also applicable to automatic stop control of an internal combustion engine having seven or more cylinders. The embodiment of the invention is preferably applied to a hybrid vehicle having a rotary machine (e. g. electric motor) such as a motor-generator or the like as a driving force source for running in addition to an internal combustion engine that is connected to a power transmission path via a disconnecting/connecting device such as a clutch or the like. Accordingly, the embodiment of the invention is applied to automatic stop control during the driving of the vehicle that is provided with a stop-and-start system of the engine for stopping the internal combustion engine during a motor running mode in which the vehicle runs with only the rotary machine serving as a driving force source, during coasting with an accelerator turned OFF, during deceleration or the like. The embodiment of the invention is applicable to an engine-driven vehicle or the like that is equipped only with an internal combustion engine as a driving force source for running. The embodiment of the invention is not limited to these, and is also applicable to automatic stop control during idling stop for stopping the internal combustion engine when the vehicle is stopped.

The embodiment of the invention is configured, for example, to adjust the stop position of a crankshaft by carrying out fuel injection and ignition for a cylinder in an expansion stroke both if a stop at the top dead center (hereinafter, TDC) has occurred and if a stop at the TDC has been predicted. It is also acceptable to adjust the stop position of the crankshaft only in the case where a stop at the TDC has occurred. In that case, it is not absolutely necessary to predict a stop at the TDC. If a stop at the TDC can be predicted with high accuracy, the stop position of the crankshaft may be adjusted only in the case where a stop at the TDC has been predicted.

The cylinder in the expansion stroke where fuel injection and ignition are carried out to adjust the stop position of the crankshaft is the cylinder located immediately in front of (preceding) the cylinder with a stop at the compression TDC. For example, this cylinder is a cylinder with a stop in the vicinity of 120 ATDC in the case where there are six cylinders, and is a cylinder with a stop in the vicinity of 103 ATDC in the case where there are seven cylinders. In the embodiment of the invention, fuel injection and ignition are carried out after a recovery condition determined in advance on an in-cylinder pressure of the cylinder in the expansion stroke has been attained. However, the invention is not limited to this embodiment thereof. In the case where the amount of pressure leak in a compression stroke is small, it is also acceptable to carry out fuel injection and ignition immediately after the detection of a stop at the TDC, without awaiting the recovery of the in-cylinder pressure. On the other hand, in the case where a stop at the TDC has been predicted, it is also acceptable to carry out fuel injection and ignition after the crankshaft has stopped rotating. However, it is also possible to carry out fuel injection and ignition before the crankshaft stops rotating.

In the embodiment of the invention, if a stop at a TDC has been predicted in an internal combustion engine that is equipped with a variable valve timing device that changes the timing for opening an exhaust valve, the timing for opening the exhaust valve is retarded before the crankshaft stops rotating. However, the invention is not limited to this embodiment thereof. The invention is also applicable to an internal combustion engine that is not equipped with a variable valve timing device. Even in the case where the variable valve timing device for the exhaust valve is provided, it is not absolutely necessary to always carry out retardation, but it is sufficient to carry out retardation as the need arises.

Hereinafter, the embodiment of the invention will be described in detail with reference to the drawings. FIG. 1 is a schematic block diagram including a skeleton diagram of a drive system of a hybrid vehicle 10 that is applied to the embodiment of the invention. This hybrid vehicle 10 is equipped with a direct-injection engine 12 having cylinders into which fuel is directly injected, and a motor-generator MG that functions as an electric motor and a generator, as driving force sources for running. Outputs of the direct-injection engine 12 and the motor-generator MG are transmitted from a torque converter 14 as a fluid-type transmission device to an automatic transmission 20 via a turbine shaft 16 and a C1 clutch 18, and are further transmitted to right and left driving wheels 26 via an output shaft 22 and a differential gear unit 24. The torque converter 14 is equipped with a lockup clutch (L/U clutch) 30 that directly couples a pump impeller and a turbine impeller to each other. An oil pump 32 is integrally connected to the pump impeller, and is mechanically driven to be rotated by the direct-injection engine 12 and the motor-generator MG The direct-injection engine 12 is an internal combustion engine, and the motor-generator MG is equivalent to a rotary machine.

Figure 2:
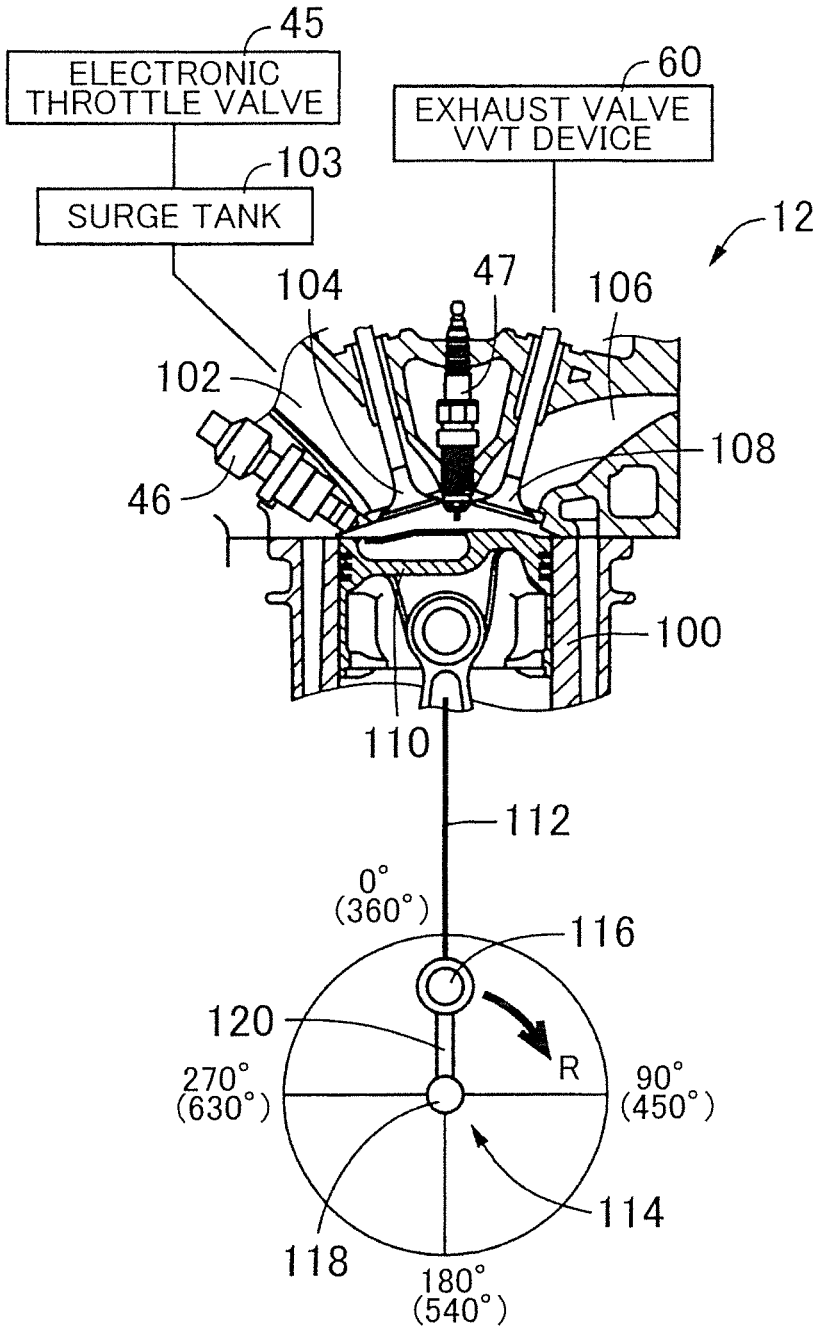
FIG. 2 is a cross-sectional view illustrating a direct-injection engine of the hybrid vehicle of FIG. 1.

The direct-injection engine 12 is a four-cycle gasoline engine having six cylinders. As shown specifically in FIG. 2, the direct-injection engine 12 is designed such that high-pressure fuel spray of gasoline is directly injected into a cylinder 100 by a fuel injector 46. The direct-injection engine 12 is designed such that air flows into the cylinder 100 from an intake passage 102 via an intake valve 104, and that exhaust gas is discharged from an exhaust passage 106 via an exhaust valve 108. In the direct-injection engine 12, the mixture in the cylinder 100 is ignited by an igniter 47 at a predetermined timing, and explodes and burns to press a piston 110 downward. The intake passage 102 is connected to an electronic throttle valve 45 as an intake air amount adjustment valve, via a surge tank 103. The amount of intake air flowing into the cylinder 100 from the intake passage 102, namely, the engine output is controlled in accordance with the opening degree of the electronic throttle valve 45 (throttle valve opening degree). The exhaust valve 108 is opened/closed via the exhaust valve VVT device 60. The exhaust valve VVT device 60 is a variable valve timing device that makes the timing for opening the exhaust valve 108 variable, and changes the timing for opening the exhaust valve 108 in accordance with a signal from an electronic control unit 70 (see FIG. 1).

The piston 110 is axially slidably fitted in the cylinder 100. The piston 110 is relatively rotatably coupled to a crankpin 116 of a crankshaft 114 via a connecting rod 112, and the crankshaft 114 is rotationally driven as indicated by an arrow R as the piston 110 rectilinearly moves in a reciprocating manner. The crankshaft 114 has a journal portion 118 that is rotatably supported by a bearing, and is integrally equipped with a crank arm 120 that connects the journal portion 118 and the crankpin 116 to each other.

Figure 3:
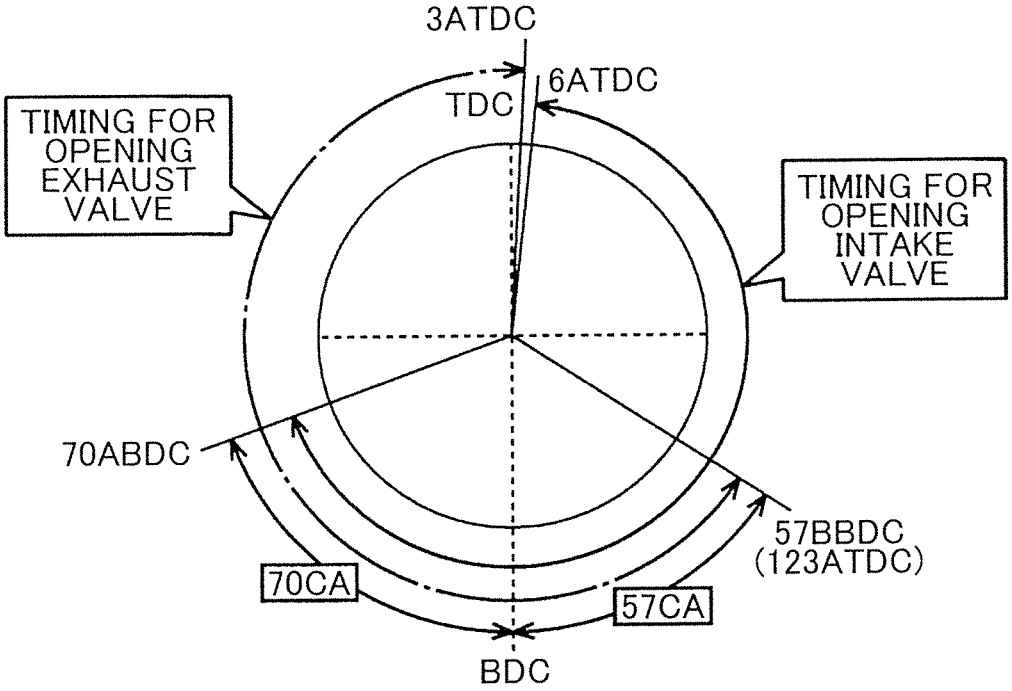
FIG. 3 is a view illustrating timings for opening intake and exhaust valves of the direct-injection engine of FIG. 2.

This direct-injection engine 12 undergoes four strokes, namely, an intake stroke, a compression stroke, an expansion (explosion) stroke, and an exhaust stroke while the crankshaft 114 rotates by two turns (720 CA). The crankshaft 114 is continuously rotated through the repetition of this process. The pistons 110 of the six cylinders 100 are configured such that crank angles F thereof are offset from one another by 120 CA respectively. Every time the crankshaft 114 rotates by 120 CA, the six cylinders 100 are sequentially subjected to explosion and combustion, so a running torque is successively generated. FIG. 3 is a view illustrating an example of timings for opening intake and exhaust valves in one of the cylinders 100. The intake valve 104 is opened while the crank angle F during the first turn is between 6 ATDC and 70 ABDC, namely, in a region from the intake stroke to the compression stroke. The exhaust valve 108 is opened when the crank angle F during the second turn is 57 BBDC, namely, in a final phase of the expansion stroke, and is closed when the crank angle F during the first turn in the subsequent cycle is 3 ATDC, namely, at a border between the exhaust stroke and the intake stroke. The timing for opening this exhaust valve 108 is when the timing for opening the exhaust valve is retarded by the exhaust valve VVT device 60. The timing for opening the exhaust valve 108 in the case of advancement is before 57 BBDC. For example, the exhaust valve 108 is opened at about 70 BBDC (110 ATDC).

Figure 4:
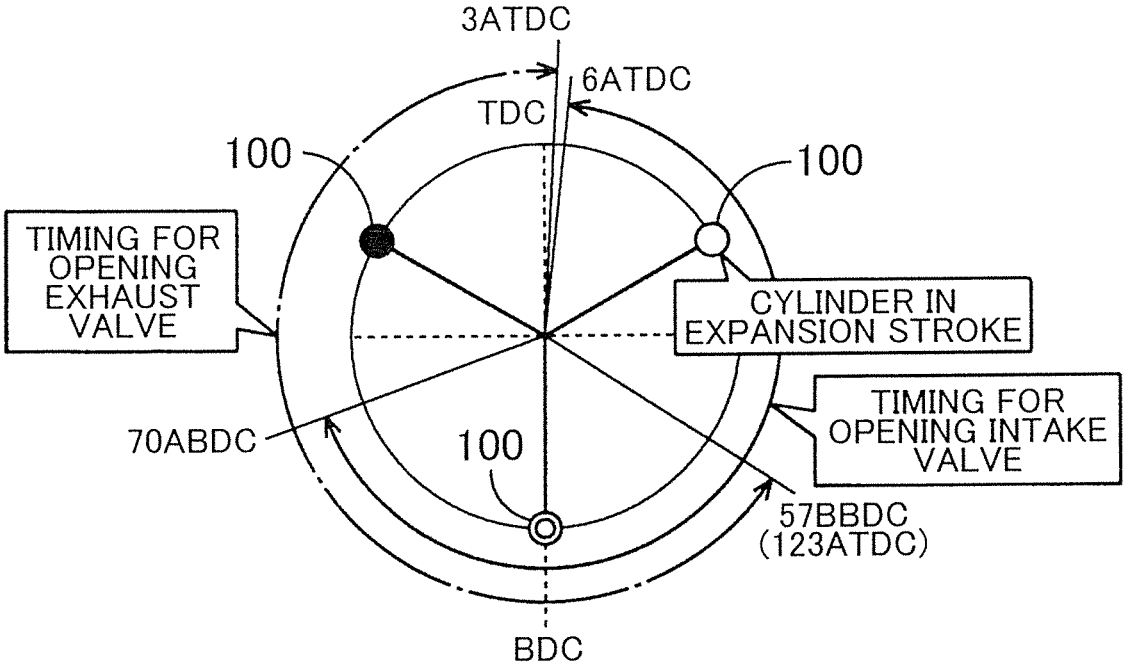
FIG. 4 is a view illustrating an example of positions of pistons (crank angles) in respective cylinders during a stop of rotation of the direct-injection engine.

In the direct-injection engine 12, when the piston 110 in any one of the cylinders 100 is stopped within a predetermined angular range of the expansion stroke in which both the intake valve 104 and the exhaust valve 108 are closed, the fuel injector 46 injects gasoline into the cylinder 100, and the igniter 47 ignites the mixture in the cylinder 100, so the mixture in the cylinder 100 is exploded and burned, and the direct-injection engine 12 is started. In this manner, ignition-based startup is made possible. In FIG. 4, in the case where the piston 110 in any one of the cylinders 100 is thus stopped at an intermediate position of the expansion stroke, the cylinder 100 with a stop at the intermediate position of the expansion stroke is denoted by "a blank circle", and both the intake valve 104 and the exhaust valve 108 are closed. Therefore, by carrying out fuel injection and ignition for the cylinder 100, a large running torque can be generated to start the direct-injection engine 12. In the case where the direct-injection engine 12 has six cylinders, if fuel injection and ignition are stopped, the crankshaft 114 is usually stopped from rotating in a natural manner such that the piston 110 in any one of the cylinders 100 thus stops at an intermediate position of an expansion stroke (e.g., in the vicinity of 45 to 75 ATDC), due to a relationship between potential energy resulting from the pumping action and a rotation inertia force. Thus, ignition-based startup is made possible. In the case where the piston 110 is stopped at the intermediate position of the expansion stroke, it may also be possible to start the direct-injection engine 12 only through ignition-based startup. However, even in the case where the direct-injection engine 12 is started through ignition while providing assistance for rotation of (cranking) the crankshaft 114 through the use of the motor-generator MG, the assist torque can be reduced. Therefore, the maximum torque of the motor-generator MG is reduced, so it is possible to achieve downsizing and high mileage (improve fuel efficiency).

Returning to FIG. 1, a K0 clutch 34 is provided between the aforementioned direct-injection engine 12 and the motor-generator MG. The K0 clutch 34 directly couples the direct-injection engine 12 and the motor-generator MG to each other via a damper 38. This K0 clutch 34 is a single-disc or multiple-disc friction clutch that is frictionally engaged by a hydraulic cylinder, and is subjected to engagement/release control by an oil pressure control device 28. The K0 clutch 34 is a hydraulic frictional engagement device, and functions as a disconnecting/connecting device that connects/disconnects the direct-injection engine 12 to/from the power transmission path. The motor-generator MG is connected to a battery 44 via an inverter 42. The automatic transmission 20 is a stepped automatic transmission of a planetary gear type or the like in which a plurality of gear stages with different speed ratios are established depending on the engagement/release state of a plurality of hydraulic frictional engagement devices (clutches and brakes). The automatic transmission 20 is subjected to shift control by electromagnetically operated oil pressure control valves, switching valves and the like that are provided in the oil pressure control device 28. The C1 clutch 18 functions as an input clutch of the automatic transmission 20, and is likewise subjected to engagement/release control by the oil pressure control device 28.

The hybrid vehicle 10 according to the present embodiment of the invention is controlled by the electronic control unit 70. The electronic control unit 70 is configured to include a so-called microcomputer having a CPU, a ROM, a RAM, an input/output interface and the like. The electronic control unit 70 performs a signal process according to a program that is stored in advance in the ROM, while utilizing a temporary storage function of the RAM. A signal representing an operation amount of an accelerator pedal (an accelerator operation amount) Acc is supplied to the electronic control unit 70 from an accelerator operation amount sensor 48. Signals regarding a rotational speed of the direct-injection engine 12 (an engine rotational speed) NE, a rotational speed of the motor-generator MG (an MG rotational speed) NMG, a rotational speed of the turbine shaft 16 (a turbine rotational speed) NT, a rotational speed of the output shaft 22 (an output shaft rotational speed that corresponds to a vehicle speed V) NOUT, a rotational angle from a top dead center (a TDC) for each of the six cylinders 100 (a crank angle) F are supplied to the electronic control unit 70 from an engine rotational speed sensor 50, an MG rotational speed sensor 52, a turbine rotational speed sensor 54, a vehicle speed sensor 56, and a crank angle sensor 58 respectively. Moreover, various pieces of information required for various kinds of control are supplied to the electronic control unit 70. The aforementioned accelerator operation amount Acc is equivalent to an output request amount.

The aforementioned electronic control unit 70 is equipped with hybrid control means 72, shift control means 74, running control means 76, and engine stop control means 80. The hybrid control means 72 controls the operations of the direct-injection engine 12 and the motor-generator MG. Thus, the vehicle runs while making a switchover among a plurality of predetermined running modes, for example, an engine running mode in which the vehicle runs using only the direct-injection engine 12 as a driving force source, a motor running mode in which the vehicle runs using only the motor-generator MG as a driving force source, an engine+motor running mode in which the vehicle runs using both the direct-injection engine 12 and the motor-generator MG, and the like, in accordance with operation states such as the accelerator operation amount Acc, the vehicle speed V and the like. The shift control means 74 controls the electromagnetically operated oil pressure control valves, the switching valves and the like that are provided in the oil pressure control device 28, thereby making a switchover in the engagement/release states of the plurality of the hydraulic frictional engagement devices.

Thus, a switchover is made among the plurality of the gear stages of the automatic transmission 20 according to a predetermined shift map, using operation states such as the accelerator operation amount Acc, the vehicle speed V and the like as parameters. The running control means 76 releases the K0 clutch 34 under a certain condition, disconnects the direct-injection engine 12 from the power transmission path, stops the operation of the direct-injection engine 12, and performs running control for improving fuel economy, if the vehicle runs in a decelerating manner or a coasting manner with the accelerator turned OFF while running in the engine+motor running mode or the engine running mode.

Figure 5:
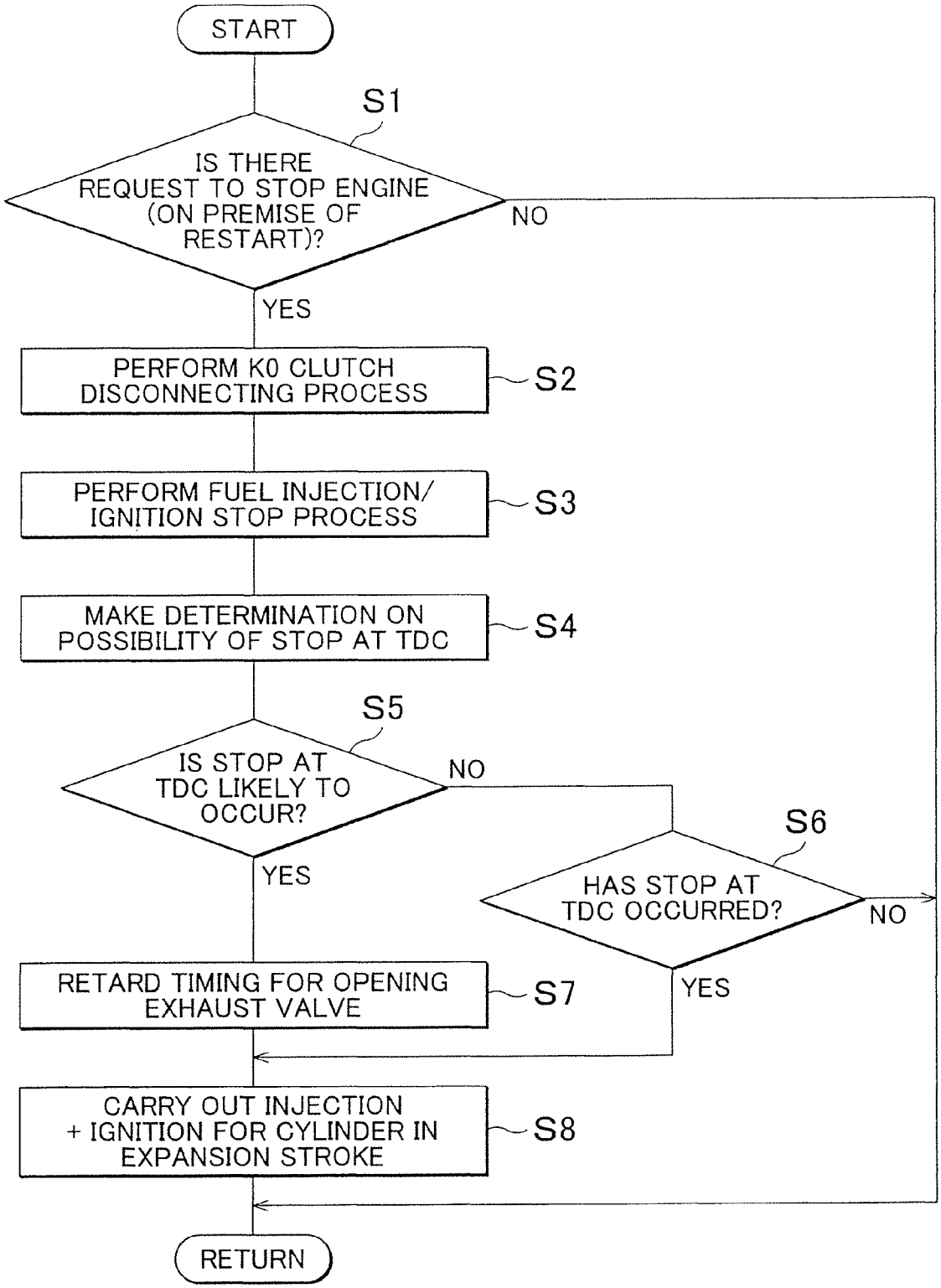
FIG. 5 is a flowchart concretely illustrating the operation of engine stop control means with which an electronic control unit of FIG. 1 is functionally equipped.
Figure 6:
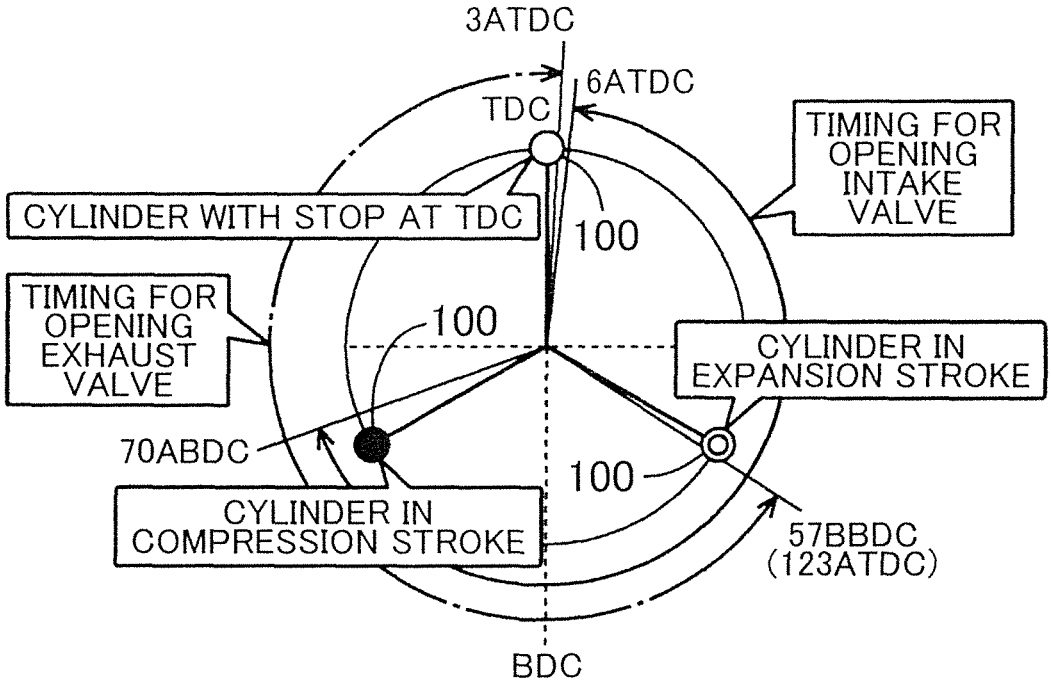
FIG. 6 is a view illustrating positions of the pistons (crank angles) in the cylinder with a stop at a compression TDC and the cylinders located in front of and behind that cylinder during a stop of the direct-injection engine of FIG. 2 at the TDC.

The engine stop control means 80 stops the direct-injection engine 12 when a switchover in mode is made from the aforementioned engine+motor running mode to the motor running mode or from the engine running mode to the motor running mode, or when running control is performed. The engine stop control means 80 is equipped with engine stop means 82, TDC stop determination means 84, and crankshaft stop position adjustment means 86, and performs a signal process according to a flowchart of FIG. 5. That is, the crankshaft 114 of the direct-injection engine 12 is usually stopped from rotating in a natural manner at a position where the piston 110 of any one of the cylinders 100 stops at an intermediate position of an expansion stroke as shown previously in FIG. 4, so ignition-based startup can be directly carried out when a request for restart is made. On the other hand, a stop at the TDC, namely, a stop of the piston 110 in any one of the cylinders 100 in the vicinity of the compression TDC may occur as shown in FIG. 6, with a probability of 5 to 10%. In this case, the crank angle F of the cylinder in the expansion stroke indicated by "a double circle" (the cylinder located immediately in front of the cylinder with a stop at the TDC) 100 is in the vicinity of 120 ATDC. Therefore, the exhaust valve 108 is already open or will open soon. Therefore, a sufficient running torque cannot be obtained through ignition-based startup. As a result, it is substantially impossible to carry out ignition-based startup. Therefore, in the case of such a stop at the TDC, the crankshaft stop position adjustment means 86 prevents the stop position of the crankshaft 114 from coinciding with a stop at the TDC. In the flowchart of FIG. 5, steps S1 to S3 are equivalent to the engine stop means 82, steps S4 to S6 are equivalent to the TDC stop determination means 84, and steps S7 and S8 are equivalent to the crankshaft stop position adjustment means 86.

In step S1 of FIG. 5, it is determined whether or not an engine stop request premised on restart has been made. Specifically, it is determined whether or not an engine stop request has been made from the hybrid control means 72 or the running control means 76 when a switchover in mode is made from the engine+motor running mode to the motor running mode or from the engine running mode to the motor running mode, or in order to perform running control. If no engine stop request has been made in step S1, the process is immediately ended. If an engine stop request has been made, step S2 and the following steps are executed.

In step S2, a process of disconnecting the K0 clutch 34 is performed to disconnect the direct-injection engine 12 from the power transmission path. Subsequently in step S3, a process of stopping the direct-injection engine 12 is performed. In this stop process, fuel injection by the fuel injector 46 is stopped (fuel cutoff), and ignition control of the igniter 47 is stopped. Thus, in conjunction with the disconnection of the direct-injection engine 12 from the power transmission path in step S2, the engine rotational speed NE is gradually reduced, so the direct-injection engine 12 is stopped from rotating. As for the process of disconnecting the K0 clutch 34 by step S2, fuel cutoff by step S3 and the like, fuel cutoff may be performed later. However, the process of disconnecting the K0 clutch 34 and fuel cutoff can be performed in parallel substantially at the same time, or fuel cutoff may be performed first.

Figure 7:
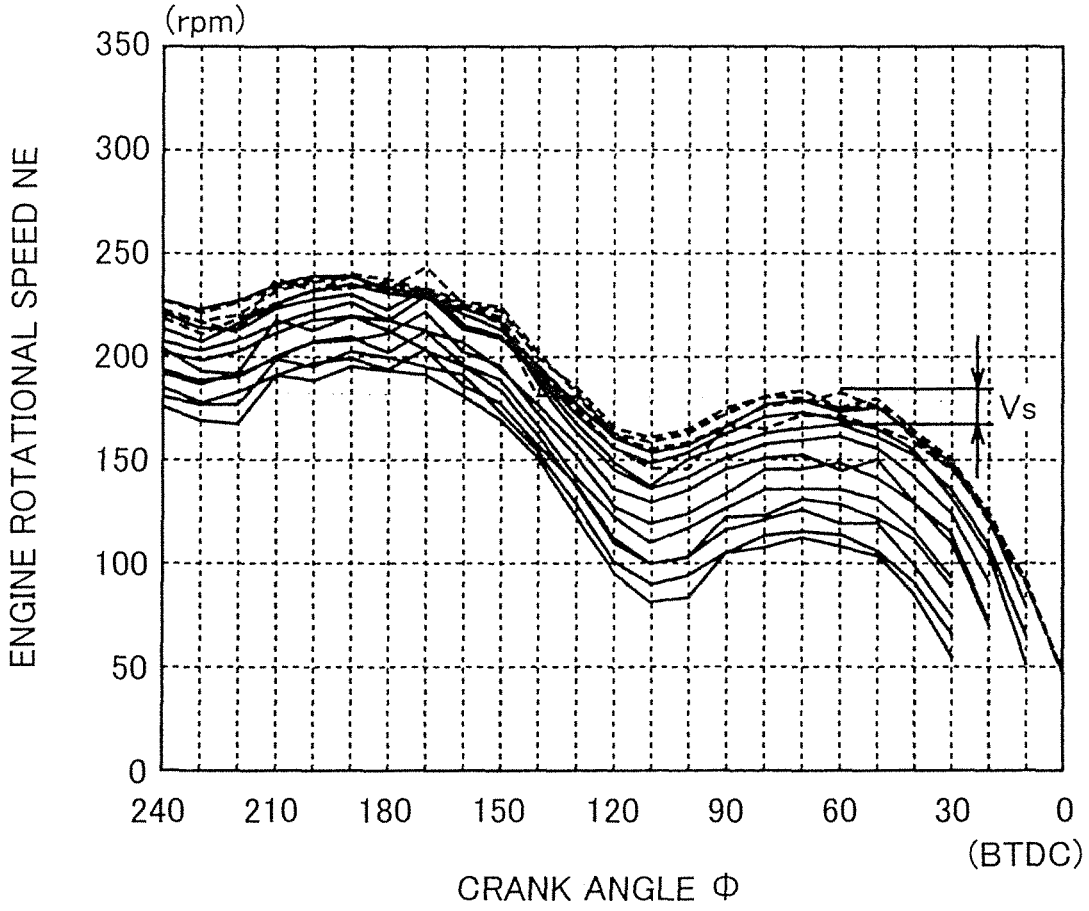
FIG. 7 is a view illustrating a criterial rotational speed Vs in predicting whether or not a crankshaft stops at the TDC in step S4 of FIG. 5.

In step S4, it is predicted whether the stop position of the crankshaft 114 at the time when the direct-injection engine 12 stops rotating coincides with a stop at the TDC. That is, when the crankshaft 114 is stopped from rotating by stopping fuel injection and ignition for the direct-injection engine 12, it can be predicted whether or not a stop at the TDC occurs, from a relationship between the crank angle F and the rotational speed in the case where a stop at the TDC occurs or in the case where a stop at the TDC does not occur. The relationship between the crank angle F and the rotational speed in the case where a stop at the TDC occurs or in the case where a stop at the TDC does not occur can be obtained in advance through an experiment, a simulation or the like. FIG. 7 shows a result obtained by checking a relationship between the crank angle F and the engine rotational speed Ne within a range of 240 CA immediately before a stop of the crankshaft 114. In FIG. 7, broken lines indicate a case where a stop at the TDC has occurred (a case where the rotation has stopped at the BTDC=0 at the right end), and solid lines indicate a case where a stop at the TDC has not occurred. As a result, if the engine rotational speed NE is within a range of Vs at, for example, 60 BTDC (at a position in front of the TDC by 60 CA), with a relatively high probability. Therefore, the rotational speed range Vs is set as a criterial rotational speed. If the engine rotational speed NE at the time when the crank angle F is equal to 60 BTDC is within the range of the criterial rotational speed Vs, it can be determined (predicted) that a stop at the TDC is likely to occur. If the engine rotational speed NE at the time when the crank angle F is equal to 60 BTDC is lower than the criterial rotational speed Vs, it can be determined that a stop at the TDC is unlikely to occur. The stop at the TDC disperses due to individual differences in the direct-injection engine 12, or varies with the passage of time. It is therefore desirable to sequentially learn (store) the correlation and correct (update) the criterial rotational speed Vs every time stop control is performed. As indicated by the solid lines in FIG. 7, the rotation is stopped at 10 to 30 BTDC. However, the actual stop position is about 45 to 75 BTDC due to the phenomenon of rocking-back resulting from the pumping action, and the rotation is stopped in a state shown previously in FIG. 4.

Subsequently in step S5, it is determined whether or not it is determined in step S4 that a stop at the TDC is likely to occur. If it is determined that a stop at the TDC is likely to occur (or a stop at the TDC may occur), step S7 and step S8 are executed. Besides, if it is determined in step S4 that a stop at the TDC is unlikely to occur (or a stop at the TDC does not occur), it is determined in step S6 whether or not a stop at the TDC has actually occurred. It can be determined whether or not a stop at the TDC has occurred, for example, depending on whether or not the stop position of the crankshaft 114 (the crank angle F in any one of the cylinders 100) is within the range of the TDC±a. It is appropriate that a be, for example, about 5 to 10 CA. If a stop at the TDC has not occurred in step S6, the process is immediately ended. However, if a stop at the TDC has occurred in step S6, step S8 is executed.

In step S7, the timing for opening the exhaust valve 108 is retarded by the exhaust valve VVT device 60 before the crankshaft 114 stops rotating. The determination on the possibility of a stop at the TDC in step S4 is made at, for example, 60 BTDC, and the engine rotational speed NE is low in this stage. Therefore, the timing for opening the exhaust valve 108 can be retarded before the crankshaft 114 stops rotating. In step S8, fuel injection and ignition are carried out for the cylinder 100 in an expansion stroke, and a normal running torque is generated through explosion to prevent the crankshaft 114 from stopping at the TDC. Thus, the piston 110 that has stopped in the vicinity of the compression TDC, or the piston 110 of the cylinder 100 whose piston is estimated to stop in the vicinity of the compression TDC advances to the expansion stroke beyond the compression TDC, and the crankshaft 114 is stopped in a natural manner through the normal running torque resulting from explosion, the pumping action, friction and the like. Thus, the above-mentioned piston 110 is stopped at an intermediate position of the expansion stroke (e.g., in the vicinity of 45 to 75 ATDC). Accordingly, when a request to start the engine is made afterward, ignition-based startup for starting the direct-injection engine 12 through fuel injection and ignition for the cylinder 100 in the expansion stroke is appropriately carried out. Engine automatic stop control according to the present embodiment of the invention is performed while running in the motor running mode or during the driving of a vehicle that is provided with a stop-and-start system of the engine. Therefore, a driver is unlikely to feel a sense of discomfort due to vibrations or the like caused by explosion for avoiding a stop at the TDC.

Figures 8A, 8B, 8C:
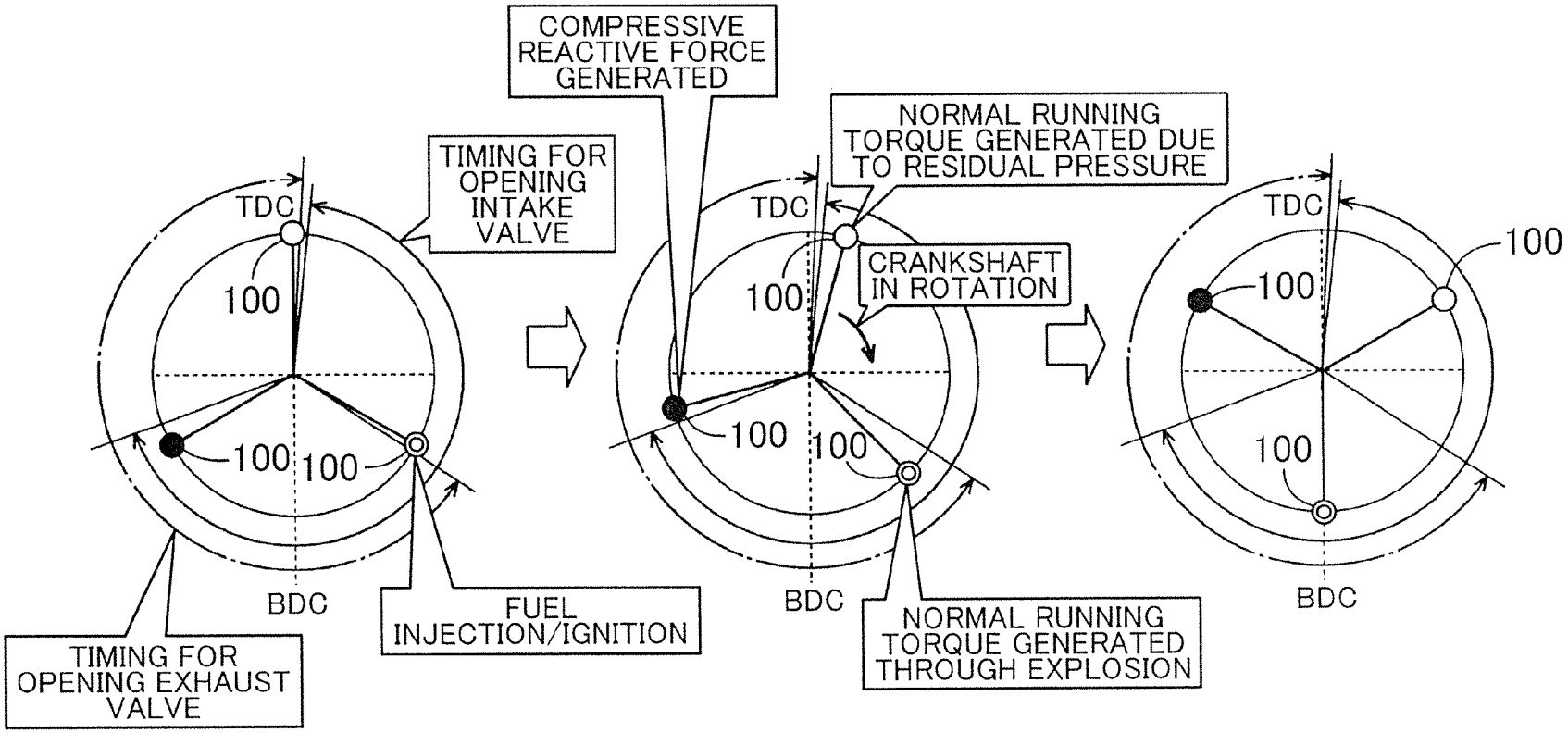
FIGS. 8A to 8C are views illustrating how the positions of the pistons (crank angles) in the cylinder with a stop at the compression TDC and the cylinders located in front of and behind that cylinder change in a case where the stop position of the crankshaft has been adjusted according to the flowchart of FIG. 5.

FIGS. 8A to 8C are views illustrating how the positions of the pistons (the crank angles) in the cylinder with a stop at the compression TDC and the cylinders located in front of and behind that cylinder change in the case where the stop position of the crankshaft 114 is adjusted in the aforementioned step S8. FIG. 8A is a view illustrating fuel injection and ignition in a state of a stop at the TDC. FIG. 8B is a view illustrating the generation of a normal running torque. FIG. 8C is a view illustrating a stop of the piston 110 in the vicinity of the center of the cylinder. In FIG. 8A, fuel injection and ignition are carried out for the cylinder 100 in an expansion stroke indicated by "a double circle". Then, as shown in FIG. 8B, a normal running torque is generated due to explosion in the cylinder 100 indicated by "the double circle", and a torque in a normal rotating direction is applied to the crankshaft 114. If the crankshaft 114 thus escapes a stop at the TDC, a normal running torque is generated in the cylinder 100 at the compression TDC indicated by "a blank circle", due to a residual pressure. On the other hand, a compressive reactive force is generated in the cylinder 100 in a compression stroke that is indicated by "a filled circle" and located immediately behind that cylinder, due to the closing of the intake valve 104. In the cylinder 100 indicated by "the double circle", the normal running torque swiftly decreases due to a pressure leak resulting from the opening of the exhaust valve 108. Accordingly, as shown in FIG. 8C, the crankshaft 114 is rotated in the normal direction while these forces are balanced with one another. Also, for reasons of the pumping action and the friction of the respective parts, the crankshaft 114 is stopped from rotating at a crank position where the cylinder 100 indicated by "the blank circle" corresponds to the intermediate position of the expansion stroke, namely, at a position that is suited for ignition-based startup during restart.

It should be noted herein that if it is determined in step S5 that a stop at the TDC may occur, the timing for opening the exhaust valve 108 is retarded in step S7. Therefore, the exhaust valve 108 in the cylinder 100 indicated by "the double circle" in FIG. 8A is held closed, and a normal running torque is appropriately generated through explosion resulting from fuel injection and ignition. Accordingly, the crankshaft 114 can be prevented from stopping at the TDC. If it is determined in step S5 that a stop at the TDC may occur, fuel injection and ignition can be carried out for the cylinder 100 indicated by "the double circle" in FIG. 8A before the crankshaft 114 completely stops rotating. In this case, there still remains a rotational inertia, so the crankshaft 114 can be reliably prevented from stopping at the TDC. In consequence, the crankshaft 114 passes the TDC stop position and is stopped from rotating at a crank position shown in FIG. 8C, without stopping at the TDC.

On the other hand, if a stop at the TDC is actually detected in step S6, fuel injection and ignition are carried out in step S8 with the crankshaft 114 completely stopped from rotating. Even if it is determined in step S5 that a stop at the TDC may occur (is likely to occur), fuel injection and ignition can be carried out in step S8 after the crankshaft 114 has completely stopped rotating. In this case, the rotation inertia force of the crankshaft 114 is 0, but the crankshaft 114 can be prevented from stopping at the TDC by being rotated by explosion resulting from fuel injection and ignition for the cylinder 100 indicated by "the double circle" in FIG. 8A. In the case where a stop at the TDC is detected in step S6, if the timing for opening the exhaust valve 108 is advanced by the exhaust valve VVT device 60, the exhaust valve 108 of the cylinder 100 indicated by "the double circle" in FIG. 8A may already be open. In this case, if a certain condition on the valve-open state of the exhaust valve 108 or the like is fulfilled, the crankshaft 114 can be prevented from stopping at the TDC through fuel injection and ignition in step S8. The crank angle F of the cylinder 100 indicated by "the double circle" is in the vicinity of 120 ATDC, and the volume of the combustion chamber is relatively large. Therefore, the amount of oxygen is large, and a large explosive force can be generated.

The cylinder 100 indicated by "the double circle" in FIG. 8A has undergone a compression stroke as the crankshaft 114 rotates through inertia before stopping rotating. Therefore, a pressure leak occurs from the gap of an abutment of a piston ring, and the pressure in the cylinder 100 is likely to be negative immediately after a stop in an expansion stroke. Accordingly, even if fuel injection and ignition are immediately carried out, a sufficient running torque may not be obtained due to an insufficiency in oxygen. Therefore, it is desirable to carry out fuel injection and ignition after the in-cylinder pressure of the cylinder 100 indicated by "the double circle" has recovered as shown in, for example, FIG. 9. That is, it is determined in step R1 whether or not a recovery condition determined in advance on the in-cylinder pressure of the cylinder 100 indicated by "the double circle" has been attained. If the recovery condition of R1 has been attained, fuel injection and ignition are carried out for the cylinder 100 indicated by "the double circle" in step R2. Thus, air flows into the cylinder 100 indicated by "the double circle", in which the piston 110 has stopped in the expansion stroke, from the gap of the abutment of the piston ring thereof, so the in-cylinder pressure recovers in a natural manner to the vicinity of the atmospheric pressure. Therefore, a running torque that is neither too small nor too large to prevent the crankshaft 114 from stopping at the TDC can be generated by carrying out fuel injection and ignition after the predetermined recovery condition has been attained. The determination on recovery in step R1 can be made by, for example, detecting an in-cylinder pressure Pin of the cylinder 100 indicated by "the double circle" with the aid of an in-cylinder pressure sensor (not shown) and determining whether or not the in-cylinder pressure Pin has reached a predetermined recovery pressure Pk in the vicinity of the atmospheric pressure. The recovery condition in the present embodiment of the invention is set as Pin≥Pk. The in-cylinder pressure Pin recovers to the vicinity of the atmospheric pressure in, for example, several seconds (about one to three seconds). Therefore, the determination on recovery in step R1 can also be made on a recovery condition that an elapsed time Tstp after a stop of rotation of the crankshaft 114 have reached a predetermined recovery time Tk, namely, that Tstp≥Tk.

As described hitherto, in an automatic stop control apparatus for the direct-injection engine 12 according to the present embodiment of the invention, if a stop at the TDC is predicted (the result of the determination in step S5 is YES) or if the stop at the TDC has occurred (the result of the determination in step S6 is YES), fuel injection and ignition are carried out for the cylinder 100 in the expansion stroke (the cylinder indicated by "the double circle" in FIG. 8A), and a normal running torque is generated through explosion, so the crankshaft 114 is rotated. Thus, the crankshaft 114 is prevented from stopping at the TDC. That is, the piston 110 of the cylinder 100 (the cylinder indicated by "the blank circle" in FIG. 8A) whose piston 110 has stopped or is estimated to stop in the vicinity of the compression TDC advances to the expansion stroke beyond the compression TDC due to normal rotation of the crankshaft 114 resulting from explosion, and the crankshaft 114 is stopped in a natural manner due to the normal running torque, potential energy resulting from the pumping action, friction and the like. As a result, the crankshaft 114 is stopped at an intermediate position of the expansion stroke. Thus, when a request to start the engine is made afterward, ignition-based startup for starting the direction-injection engine 12 through fuel injection and ignition for the cylinder 100 in the expansion stroke (the cylinder indicated by "the blank circle" in FIG. 8C) is always appropriately carried out. In the present embodiment of the invention in particular, step S8 is executed to adjust the stop position of the crankshaft 114 not only if a stop at the TDC has been predicted but also if a stop at the TDC has actually occurred. Therefore, a stop at the TDC is prevented.

In that case, fuel injection and ignition are carried out for the cylinder 100 in the expansion stroke (the cylinder indicated by "the double circle" in FIG. 8A), and the crankshaft 114 is prevented from stopping at the TDC by being rotated in the normal direction through explosion. Therefore, there is no need to enlarge the motor-generator MG in a manner corresponding to the control torque as in the case where the stop position of the crankshaft 114 is controlled through the use of, for example, the motor-generator MG. As a result, an inexpensive configuration can be realized through the direct use of existing parts and the like. Fuel injection and ignition are carried out for the cylinder 100 in the expansion stroke to prevent the crankshaft 114 from stopping at the TDC. For example, fuel injection and the like can be carried out after a stop at the TDC has occurred. Therefore, in comparison with a case where the crankshaft 114 is stopped from rotating by burning the mixture in the cylinder in the compression stroke, the control is easier to perform, and a stop at the TDC can be avoided with higher accuracy.

Figure 9:
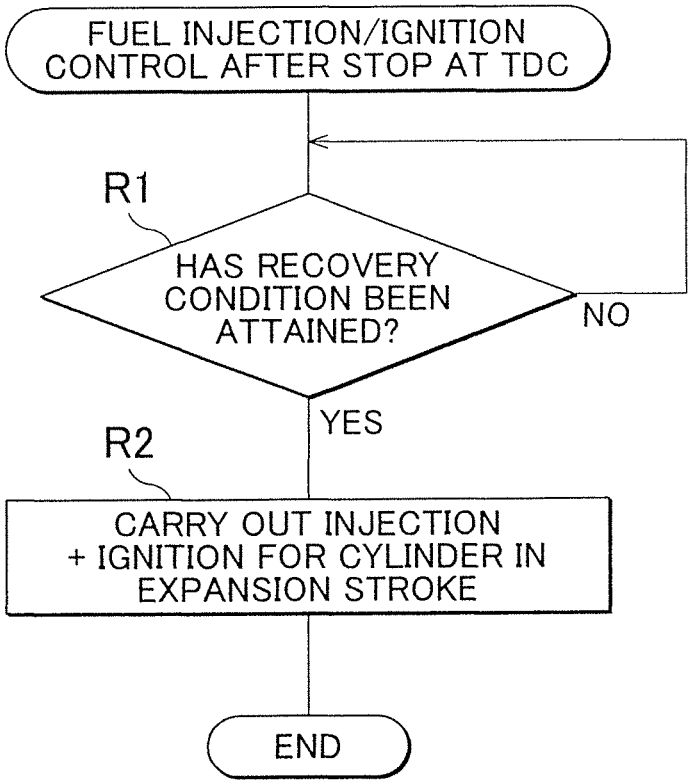
FIG. 9 is a flowchart illustrating the operation in a case where fuel injection and ignition are carried out to adjust the stop position of the crankshaft after a predetermined recovery condition on an in-cylinder pressure of the cylinder in an expansion stroke has been attained, according to the embodiment of the invention.

In the case where fuel injection and ignition are carried out for the cylinder 100 in the expansion stroke (the cylinder indicated by "the double circle" in FIG. 8A) after a stop at the TDC has occurred, it is appropriate to carry out fuel injection and ignition after the recovery condition determined in advance on the in-cylinder pressure of the cylinder 100 has been attained as shown in FIG. 9. Thus, since a sufficient amount of oxygen is contained in the cylinder 100, a large normal running torque is obtained through explosion, so the crankshaft 114 can be reliably prevented from stopping at the TDC.

In the present embodiment of the invention, the exhaust valve VVT device 60 that changes the timing for opening the exhaust valve 108 is provided. The exhaust valve 108 of the cylinder 100 in the expansion stroke (the cylinder indicated by "the double circle" in FIG. 8A) may already be open when a stop at the TDC occurs. However, if a stop at the TDC is predicted in step S5, the timing for opening the exhaust valve 108 is retarded by the exhaust valve VVT device 60 before the crankshaft 114 stops rotating in step S7. Accordingly, the exhaust valve 108 of the cylinder 100 in the expansion stroke is reliably held closed when a stop at the TDC occurs. As a result, a running torque that is neither too small nor too large to prevent the crankshaft 114 from stopping at the TDC can be generated through explosion resulting from fuel injection and ignition.

The operation and effect of the automatic stop control apparatus for the internal combustion engine presented in the aforementioned embodiment of the invention are as follows. That is, if a stop at the TDC is predicted or if the stop at the TDC has occurred, fuel injection and ignition are carried out for the cylinder in the expansion stroke, and a normal running torque is generated through explosion to rotate the crankshaft. As a result, the crankshaft is prevented from stopping at the TDC. In consequence, the piston of the cylinder whose piston has stopped or is estimated to stop in the vicinity of the compression TDC advances to the expansion stroke beyond the compression TDC due to normal rotation of the crankshaft resulting from explosion, and the crankshaft is stopped in a natural manner due to the normal running torque, potential energy resulting from the pumping action, friction and the like. As a result, the piston is stopped at an intermediate position of the expansion stroke. Thus, when a request to start the internal combustion engine is made afterward, ignition-based startup for starting the internal combustion engine through fuel injection and ignition for the cylinder in the expansion stroke is appropriately carried out.

In the aforementioned embodiment of the invention, if a stop at the TDC is predicted or if the stop at the TDC has occurred, fuel injection and ignition are carried out for the cylinder in the expansion stroke, and the crankshaft is prevented from stopping at the TDC by being rotated in the normal direction through explosion. Therefore, there is no need to enlarge the motor-generator as in the case where the stop position of the crankshaft is controlled through the use of, for example, the motor-generator. As a result, an inexpensive configuration can be realized through the direct use of existing parts and the like. Besides, fuel injection and ignition are carried out for the cylinder in the expansion stroke to prevent the crankshaft from stopping at the TDC. For example, fuel injection and the like can be carried out after a stop at the TDC has occurred. Therefore, in comparison with a case where the crankshaft is stopped from rotating by burning the mixture in the cylinder in the compression stroke, the control is easier to perform, and a stop at the TDC can be avoided with higher accuracy.

In the aforementioned embodiment of the invention, when fuel injection and ignition are carried out for the cylinder in the expansion stroke after a stop at the TDC has occurred, the fuel injection and ignition are carried out after the recovery condition determined in advance on the in-cylinder pressure of the cylinder has been attained. Therefore, a sufficient amount of oxygen is contained in the cylinder, and a large normal running torque is obtained through explosion, so the crankshaft can be reliably prevented from stopping at the TDC. That is, the cylinder whose piston has stopped in the expansion stroke has undergone the compression stroke as the crankshaft rotates through inertia before stopping rotating. Therefore, a pressure leak occurs from the gap of the abutment of the piston ring, and the pressure in the cylinder is likely to be negative immediately after the crankshaft has stopped in the expansion stroke. Even if fuel injection and ignition are immediately carried out, a sufficient running torque may not be obtained due to an insufficiency in oxygen. On the other hand, air flows into the cylinder in which the piston has stopped in the expansion stroke, from the gap of the abutment of the piston ring thereof, so the in-cylinder pressure recovers in a natural manner to the vicinity of the atmospheric pressure. Therefore, a running torque that is neither too small nor too large to prevent the crankshaft from stopping at the TDC can be generated by carrying out fuel injection and ignition after the predetermined recovery condition has been attained.

Besides, in the case where the variable valve timing device that changes the timing for opening the exhaust valve is provided, the exhaust valve of the cylinder in which the piston has stopped in the expansion stroke may already be open at the time of a stop at the TDC. According to the aforementioned embodiment of the invention, when a stop at the TDC is predicted, the timing for opening the exhaust valve is retarded by the variable valve timing device before the crankshaft stops rotating. Therefore, the exhaust valve of the cylinder in the expansion stroke is likely to be held closed at the time of a stop at the TDC. Thus, a running torque that is neither too small nor too large to prevent the crankshaft from stopping at the TDC can be generated through explosion resulting from fuel injection and ignition for the cylinder in the expansion stroke.

Although the embodiment of the invention has been described above in detail based on the drawings, this is nothing more than one embodiment of the invention. The invention can be carried out in a mode that is subjected to various modifications and improvements based on the knowledge of those skilled in the art.

What is claimed is:

1. A vehicle comprising:

an internal combustion engine including a first cylinder;

a second cylinder;

a piston in the first cylinder;

a crankshaft;

a fuel injector corresponding to the second cylinder; and an igniter corresponding to the second cylinder; and an electronic control unit configured to predict, based on a rotational speed and an angle of the crankshaft, whether the piston is going to stop at a vicinity of a top dead center when a fuel injection and an ignition for the first cylinder and a fuel injection and an ignition for the second cylinder of the internal combustion engine are stopped upon fulfillment of a predetermined stop condition, wherein the vicinity of the top dead center is a predetermined range including the top dead center; and send a signal to the fuel injector for injecting fuel to the second cylinder and send a signal to the igniter for igniting the fuel in the second cylinder in response to the prediction that the piston in the first cylinder is going to stop at the vicinity of the top dead center.

2. The vehicle of claim 1, wherein the electronic control unit is configured to change an opening timing of an exhaust valve of the internal combustion engine in response to the prediction that the piston in the first cylinder is going to stop at the vicinity of the top dead center.

3. The vehicle of claim 2, wherein the electronic control unit is configured to delay the opening timing of the exhaust valve before the crankshaft stops rotating in response to the prediction that the piston in the first cylinder is going to stop at the vicinity of the top dead center.

4. The vehicle of claim 1, wherein the electronic control unit is configured to determine whether a recovery condition for the second cylinder is satisfied before sending the signal to the fuel injector for injecting fuel to the second cylinder, and the recovery condition is a predetermined condition related to an in-cylinder pressure of each of the first cylinder and the second cylinder measured by an in-cylinder pressure sensor.

5. The vehicle of claim 1, wherein the internal combustion engine includes six cylinders.

6. The vehicle of claim 1, wherein the second cylinder is in an expansion stroke when the fuel injection and the ignition for the internal combustion engine are stopped.

7. The vehicle of claim 1, wherein the internal combustion engine is a four-cycle engine.

8. The vehicle of claim 1, wherein the predetermined range is a range of 20 crank angle.

9. The vehicle of claim 1, wherein the predetermined range is a range between the top dead center minus 10 crank angle and the top dead center plus 10 crank angle.

10. A control system for a vehicle comprising an internal combustion engine including a first cylinder, a second cylinder, and a crankshaft, the control system comprising an electronic control unit configured to predict, based on a rotational speed and an angle of the crankshaft, whether a piston in the first cylinder is going to stop at a vicinity of a top dead center when a fuel injection and an ignition for the first cylinder and a fuel injection and an ignition for the second cylinder of the internal combustion engine are stopped upon fulfillment of a predetermined stop condition, wherein the vicinity of the top dead center is a predetermined range including the top dead center; and send a signal to a fuel injector for injecting fuel to the second cylinder and send a signal to an igniter for igniting the fuel in the second cylinder in response to the prediction that the piston in the first cylinder is going to stop at the vicinity of the top dead center.

11. The control system of claim 10, wherein the electronic control unit is configured to change an opening timing of an exhaust valve of the internal combustion engine in response to the prediction that the piston in the first cylinder is going to stop at the vicinity of the top dead center.

12. The control system of claim 11, wherein the electronic control unit is configured to delay the opening timing of the exhaust valve before the crankshaft stops rotating in response to the prediction that the piston in the first cylinder is going to stop at the vicinity of the top dead center.

13. The control system of claim 10, wherein the electronic control unit is configured to determine whether a recovery condition for the second cylinder is satisfied before sending the signal to the fuel injector for injecting fuel to the second cylinder, and the recovery condition is a predetermined condition related to an in-cylinder pressure of each of the first cylinder and the second cylinder measured by an in-cylinder pressure sensor.

14. The control system of claim 10, wherein the predetermined range is a range between the top dead center minus 10 crank angle and the top dead center plus 10 crank angle.

15. A method for controlling an internal combustion engine including a first cylinder, a second cylinder, a piston in the first cylinder, and a crankshaft, the method comprising:

predicting, by an electronic control unit, whether the piston in the first cylinder is going to stop at a vicinity of a top dead center when a fuel injection and an ignition for the first cylinder and a fuel injection and an ignition for the second cylinder of the internal combustion engine are stopped upon fulfillment of a predetermined stop condition based on a rotational speed and an angle of the crankshaft, wherein the vicinity of the top dead center is a predetermined range including the top dead center; and sending, by the electronic control unit, a signal to a fuel injector for injecting fuel to the second cylinder and sending a signal to an igniter for igniting the fuel in the second cylinder in response to the prediction that the piston in the first cylinder is going to stop at the vicinity of the top dead center.

16. The method of claim 15, further comprising changing, by the electronic control unit, an opening timing of an exhaust valve of the internal combustion engine in response to the prediction that the piston in the first cylinder is going to stop at the vicinity of the top dead center.

17. The method of claim 16, further comprising delaying, by the electronic control unit, the opening timing of the exhaust valve before the crankshaft stops rotating in response to the prediction that the piston in the first cylinder is going to stop at the vicinity of the top dead center.

18. The method of claim 15, further comprising determining, by the electronic control unit, whether a recovery condition for the second cylinder is satisfied before sending the signal to the fuel injector for injecting fuel to the second cylinder, wherein the recovery condition is a predetermined condition related to an in-cylinder pressure of each of the first cylinder and the second cylinder measured by an in-cylinder pressure sensor.

19. The method of claim 15, wherein the predetermined range is a range between the top dead center minus 10 crank angle and the top dead center plus 10 crank angle.

* * * * *